United States Patent [19]

Frilund et al.

[11] 4,451,337

[45] May 29, 1984

[54] HEAT RECOVERY IN ALUMINIUM-MELTING WORKS

[76] Inventors: Eyvind Frilund, Hasselvägen 7, Åkarp, Sweden, S-232 02; Per Holmberg, Hospitalsgatan 12 B, Lund, Sweden, S-223 53

[21] Appl. No.: 513,967

[22] PCT Filed: Nov. 4, 1982

[86] PCT No.: PCT/SE82/00367

§ 371 Date: Jun. 30, 1983

§ 102(e) Date: Jun. 30, 1983

[87] PCT Pub. No.: WO83/01631

PCT Pub. Date: May 11, 1983

[51] Int. Cl.[3] ..... C25C 3/06; C25C 3/14

[52] U.S. Cl. ..... 204/67; 204/245

[58] Field of Search ..... 204/67, 245

[56] References Cited

U.S. PATENT DOCUMENTS

| | | | |
|---|---|---|---|
| 3,664,935 | 5/1972 | Johnson | 204/67 |
| 4,108,968 | 8/1978 | Jacobs et al. | 204/67 |
| 4,274,478 | 6/1981 | Stendahl | 165/104 |

*Primary Examiner*—Howard S. Williams

*Attorney, Agent, or Firm*—Lerner, David, Littenberg, Krumholz & Mentlik

[57] ABSTRACT

The invention relates to a method for recovery in a furnace for producing aluminium by melting electrolysis of alumina. The furnace gases are passed through a bed (23) of alumina while the bed being fluidized around a tube coil (25). Then, heat exchange takes place between the furnace gases and an external fluid passing through the tube coil, for recovering heat energy in the furnace gases.

2 Claims, 1 Drawing Figure

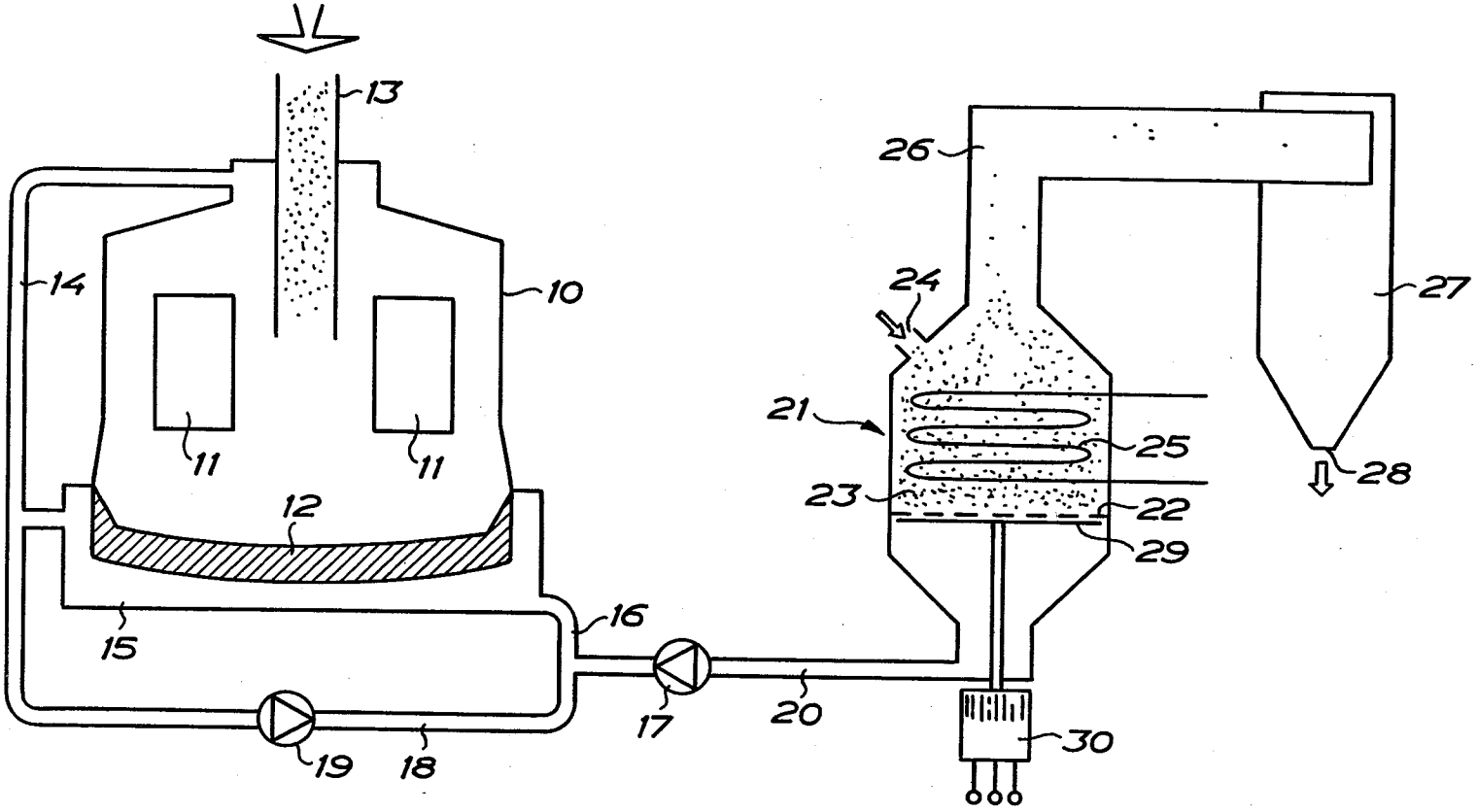
27
28
25
22
29
30
26
24
21
23
20
17
16
10
11
13
12
18
19
11
15
14

HEAT RECOVERY IN ALUMINIUM-MELTING WORKS

The present invention relates to a method of heat recovery from a furnace for manufacturing aluminium by melting electrolysis of alumina, the furnace gases being passed through a bed of alumina while the bed is being fluidized.

The melting electrolysis takes place in furnaces which have been developed specifically for that purpose and are formed as troughs which usually consist of steel and have a brick lining. Normally, the cathode is located in the bottom of the furnace and is made of carbon while the anode can be e.g. of prebaked type or Söderberg type and usually is fed from above to the electrolysis bath. It is consumed during the process and must be replaced continuously.

The alumina and certain solid additives are supplied to the electrolyte through or laterally of the anode, and the produced aluminium is drawn off batchwise by siphon or by suction.

The gas produced in the electrolysis, the furnace gas, consists of carbon monoxide, carbon dioxide, and a mixture of hydrocarbons and fluorhydrocarbons, etc., and normally is evacuated mixed with ventilation air either directly to the surrounding air in the space where the furnace is located, or to some collection means, e.g. metal sheet hoods, for the recovery of solid particles consisting of fluor salts which are entrained in the furnace gases. However, the escaping furnace gases represent a substantial amount of energy which in a plant for production of 80,000 tons raw aluminium per year is of the order of 20 MW.

For the recovery of this amount of energy and for the reduction of the energy losses in the manufacture of aluminium while the fluor salts entrained in the furnace gases are at the same time separated and recovered, it has been proposed to pass the furnace gases, when they have passed through the bed of alumina, through a heat exchanger for heat exchange between the furnace gases and an external fluid (U.S. Pat. No. 3,664,935). In that case the heat exchanger is rapidly clogged, however, due to deposition of dust from the furnace gas, such that it is necessary to clean frequently the heat exchanger.

In order to overcome this drawback it is proposed according to the invention to fluidize the bed of alumina around one or more tube coil or coils for heat exchange between the furnace gases and an external fluid passing through the tube coil or coils, respectively.

It is achieved by this procedure not only that the tube coil or coils, respectively, are continuously blown off by the particles in the fluidized bed but also that the tube coil or coils, respectively, can be made with a smaller surface and thus can be made smaller and cheaper for the transfer of a predetermined amount of heat energy, because the heat transfer factor will be several times larger due to the fluidization.

If several tube coils are provided they can be connected in series.

It is particularly advantageous to let the furnace gases pass the cathode arranged for the melting electrolysis before they are supplied to the fluidizing bed and the coil or coils, respectively. It is common that the cathode is cooled by free convection. In that case it is neccessary in the winter time when the air is cool, to compensate for the more considerable heat loss be increased supply of electric energy for the electrolysis. Due to the fact that the cooling of the cathode is obtained by means of the furnace gases there is obtained a controlled heat transport from the cathode, the energy consumption for the electrolysis thus being reduced.

In order to explain the invention more clearly it will be described in more detail below, reference being made to the accompanying drawing which discloses in a diagrammatic vertical sectional view a plant for working the method.

In the drawing, there is shown a furnace 10 for melting electrolysis of alumina comprising anodes 11 and a cathode 12. An inlet 13 for the supply of alumina to the furnace is arranged at the top. The furnace space is closed and is connected through a conduit 14 with a cooling jacket 15 arranged around the cathode 12, which is connected also to a pump 17 through a conduit 16. Between the conduits 16 and 14 there is a conduit 18 with a pump 19 for returning to the jacket furnace gas drawn off from the jacket 15. The furnace 10 and the jacket 15 preferably are heat insulated against the surroundings. By means of the pump 17 the furnace gases are drawn from the furnace through the conduit 14 and are allowed to pass through the jacket 15 for the heat exchange with the cathode 12 which is cooled as a consequence thereof. The furnace gases now further heated are supplied by means of the pump 17 through a conduit but can also be returned to the jacket 15 through the conduit 18 by means of the pump 19. By this arrangemant it is possible to control the cooling effect and thus the temperature of the cathode 12. At overtemperature of the anodes 11 compensation is automatically obtained by reduced cooling of the cathode, because the furnace gases operating as a cooling fluid then have a higher temperature. It is achieved thereby that the consumption of electric energy for the melt electrolysis is maintained at a fairly constant level at a given production level.

The conduit 20 is connected to a container 21 in which a perforated bottom 22 is arranged at some distance from the lower end of the container to support a bed 23 of alumina. This can be filled into the container through an inlet opening 24. Above the perforated bottom 22 a heat coil 25 for circulation of an external fluid is arranged inside the container, and at the top the container is connected to an outlet conduit 26 which extends to a dust separator 27 which can be of the cyclone type and has an outlet 28 for separated solid particles at the bottom thereof. A cleaner 29 is arranged below the perforated bottom 22 and is connected to an electric drivemotor 30.

The furnace gases entering the container 10 through the conduit 20 and containing some dust which consists of fluor salts, pass through the perforated bottom 22 into the bed 23 of alumina which is fluidized around the heat coil 25. Then, heat is exchanged from the hot furnace gases which have a temperature of 200° to 220° C. to the external fluid circulating in the heat coil 25, said dust at the same time adhering to the alumina. When the furnace gases escape through the conduit 26 a portion of the alumina and adhering fluor salts accompany the furnace gases but will be separated in the dust separator 27 before the furnace gases deprived of the major part of the heat content thereof and relieved from entrained dust, are discharged to the atmosphere. The material separated in the dust separator 27, which consists of alumina, enriched with fluor salts, can be supplied to the furnace through the inlet 13 or it can also be returned to the container 20 through the inlet opening 24.

The heat removed from the furnace gases by means of the external fluid circulating through the heat coil 25 can be utilized in different manners e.g. in a network for remote heating to which the heat is transferred either via heat exchangers or via heat pumps, for desalination of sea water or other water containing salt for the production of fresh water to be used industrially e.g. for the production of electric energy either by means of conventional water steam cycles or in two-media cycles, e.g. by using freon, or for production of heat and/or cold in absorption heat pumps. A combination of two or more of these utilization methods can also be adhered to. Since the heat exchange between the furnace gases and the external fluid circulating in the heat coil 25 takes place in a fluidized bed of alumina, clogging of the heat exchanger is avoider and a several times improved heat transfer is obtained. Due to this fact a less extensive apparatus will be necessary for treating the furnace gases, since the recovery of heat and the recovery of fluor salts can take place in one and the same apparatus on a compact construction.

Due to the fact that the furnace gases are allowed to take up a heat quantity from the cathode 12, which is adjusted to the process, the temperature of the furnace gases is increased and the furnace gases then remove all actual losses in a concentrated form. The method of the invention provides a substantial simplification of the heat recovery from the cathode, because an existing gas collection system and a common heat exchanger for the furnace gases and the cathode cooling can be used.

Several furnaces for melting electrolyzing can be connected to one and the same apparatus 21 which thus is common for all furnaces.

We claim:

1. A method for heat recovery in a furnace for the manufacture of aluminum by melting electrolysis of alumina, said method comprising the steps of passing furnace gases past a cathode in the furnace for heat exchange therewith while the cathode is being cooled; passing the furnace gases through a bed of alumina while the bed is being fluidized around at least one tube coil for heat exchange between the furnace gases and an external fluid passing through the at least one tube coil; removing entrained solid particles from the furnace gases which have passed through the fluidized bed of alumina, which solid particles are recovered; replenishing the fluidized bed to compensate for material removed therefrom; and supplying the recovered solid particles to the furnace.

2. A method according to claim 1, wherein the furnace gases after having passed the cathode are partly returned to pass again the cathode.

* * * * *